US006430750B1

(12) United States Patent
Tourbier et al.

(10) Patent No.: US 6,430,750 B1
(45) Date of Patent: Aug. 13, 2002

(54) SLIPPERY INSERT FOR A MECHANICAL COUNTER PRESSURE GLOVE

(75) Inventors: Dietmar Tourbier, Redondo Beach, CA (US); Mike Reddig, Mukilteo, WA (US); Christine W. Jarvis, Six Mile, SC (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/796,841

(22) Filed: Feb. 28, 2001

(51) Int. Cl.[7] ..... A41D 19/00
(52) U.S. Cl. ..... 2/160; 2/159; 2/164
(58) Field of Search ..... 2/2.11, 2.14, 16, 2/20, 81, 158, 159, 160, 161.6, 164, 167, 169, 457

(56) References Cited

U.S. PATENT DOCUMENTS 5,399,418 A 3/1995 Hartmanns et al.
5,560,044 A 10/1996 Masley
5,568,656 A * 10/1996 Kim ..... 2/164
5,636,382 A * 6/1997 Chopko et al. ..... 2/167
5,740,551 A 4/1998 Walker
5,792,531 A 8/1998 Littleton et al.
5,799,332 A 9/1998 Goodwin
5,911,313 A * 6/1999 Gold ..... 2/159
6,000,059 A * 12/1999 Abts ..... 2/161.6
6,115,850 A * 9/2000 Grilliot et al. ..... 2/457
6,154,886 A * 12/2000 Hottner ..... 2/169

* cited by examiner

*Primary Examiner*—Danny Worrell
*Assistant Examiner*—Gary L. Welch
(74) *Attorney, Agent, or Firm*—William J. Zak, Jr., Esq.

(57) ABSTRACT

A mechanical counter pressure glove system, that can be used in low-pressure environments such as outer space, is provided. The system includes a low friction base glove defining an internal volume for receiving a hand of a wearer. A pressure inducing glove is donned on the low friction glove so as to apply a mechanical pressure on the hand. The low friction material of the base glove facilitates donning of the pressure inducing glove.

15 Claims, 13 Drawing Sheets

SLIPPERY INSERT FOR A MECHANICAL COUNTER PRESSURE GLOVE

BACKGROUND OF THE INVENTION

The present invention generally relates to counter pressure garments and, more particularly, to counter pressure garments, such as gloves, that can be used in low pressure environments.

Blood pressure in a human subject's body is slightly higher than the breathing pressure. In a standard atmospheric environment this breathing pressure is equal to the external gas pressure on the skin. In environments having very small or no gas pressure, such as the vacuum of the space or very high altitude, breathing is often enhanced or enabled only by positive pressure gas supply. In these cases, a subject's circulatory balance and respiration are of great concern.

The human body is covered with a soft tissue layer. The pressure of this layer is always equal to the external gas pressure on the skin. In normal atmospheric pressure, the tissue pressure in this layer matches the blood pressure of the circulatory system. In a low pressure environment with positive pressure breathing, however, since the pressure over the tissue layer is lower, the circulating blood may rush into the tissue layer and pool. If no preventive step has been taken, the veins, particularly the capillary ones in the tissue layer, are engorged with blood. As venous engorgement continues, measurable amounts of excess fluid can be forced through the capillary walls and accumulate in the tissue layer. The accumulation of fluid can result in formation of petechiae or edema and a decrease in the circulating blood.

In such low pressure environments, a counter pressure must be applied over the soft tissue layer to prevent the aforementioned problems. Usually, a counter pressure suit is employed to provide the necessary counter pressure on the tissue layer. In the context of outer space, one such suit is a full pressure suit. It is a gas filled pressure suit that is gas tight. The counter pressure in a full pressure suit is created with high pressure oxygen supplied into the suit. Thus, the gas pressure on the skin is in balance with the breathing pressure. Typically, these suits are made of a rigid but pressure restraining outer garment.

Another type of suit is generally referred to as a partial pressure suit, used, for example, in high-altitude fighter airplanes. In a partial pressure suit, an elastic or inelastic outer garment typically covers bladders that are filled with gas. The bladders with the garment can apply a constant counter pressure over the tissue. Partial pressure suits have their advantages. For example, if the partial pressure suit is developed with elastic material, the elastic material itself can provide counter pressure to the body. The partial pressure suits tend to be less bulky and thereby increasing mobility.

One important drawback with the partial pressure suit is that in order to apply a counter pressure over a body part, that body part must be perfectly circular in shape. But the body is not circular, and instead ovate, ellipsoidal and irregular. In this context, among other body parts, hands present an exceptional difficulty. A hand has a combination of concave, convex and circular areas as well as many joints and muscular areas that change shape during contraction and relaxation.

Specifically, the hand includes a palm having five fingers. The palm has a palmar surface that contacts an object being grasped, and a dorsal surface that is the upper surface of the hand. The palmar and dorsal surfaces are defined by the bones and soft tissue covering the bones. These bones consist of five metacarpals that extend from the wrist up to the base of the fingers or so called palmar knuckles. These five metacarpals are dished, creating a metacarpal arc in the central part of the palm. At the distal ends of the metacarpals, the fingers are attached. The index, middle, ring and little fingers each have three cylindrical phalanges, with the phalanx attached to the corresponding metacarpal being the proximal phalanx, the next phalanx being the middle and the fingertips being the distal phalanx. The thumb has only two cylindrical phalanges, a proximal and distal.

Due to its importance and its complex shape, the palm has been a center of attention in various research studies. It has been observed that if used for counter pressure purposes, the elastic material of a counter pressure glove tend to primarily press the outer edge of the palm and leaves the dorsal and palmar surfaces without adequate pressure. In an effort to address this problem, bladders with various shapes are placed on the palmar and dorsal surfaces before donning the glove. However, even such conventional bladders are large and stiff, and they are not able to eliminate fluid accumulation in the soft tissue in the metacarpal area. Their large size and stiffness decrease dexterity, tactility, and mobility. Further, their size and stiffness make donning and doffing of the elastic glove more difficult. More importantly, the size and the stiffness of the bladders fatigue the elastic glove during donning and doffing resulting in a defective glove.

As can be seen, there is a need for an improved counter pressure glove that provides adequate counter pressure to the palm of a hand and is easy to don and doff as well as increase dexterity, tactility, and mobility of the hand.

SUMMARY OF THE INVENTION

A mechanical counter pressure glove system comprises a slip layer or base glove defining an internal volume for receiving a hand of a wearer and a power layer or pressure inducing glove. The pressure inducing glove is donned on the base glove so as to apply a mechanical pressure on the hand. The low friction material of the base glove facilitates donning of the pressure inducing glove.

A donning-enabling garment for use in a mechanical counter pressure glove system comprises a seamless body of a low friction material defining an internal volume for receiving a hand of a wearer. The seamless body is knitted from a yarn that is made of the low friction material. The seamless body defines a finger portion for receiving the fingers and the thumb, a palm portion for receiving the palm, and a wrist portion for receiving the wrist of the hand.

These and other features, aspects and advantages of the present invention will become better understood with reference to the following drawings, description and claims.

DETAILED DESCRIPTION OF THE INVENTION

Figure 1A:
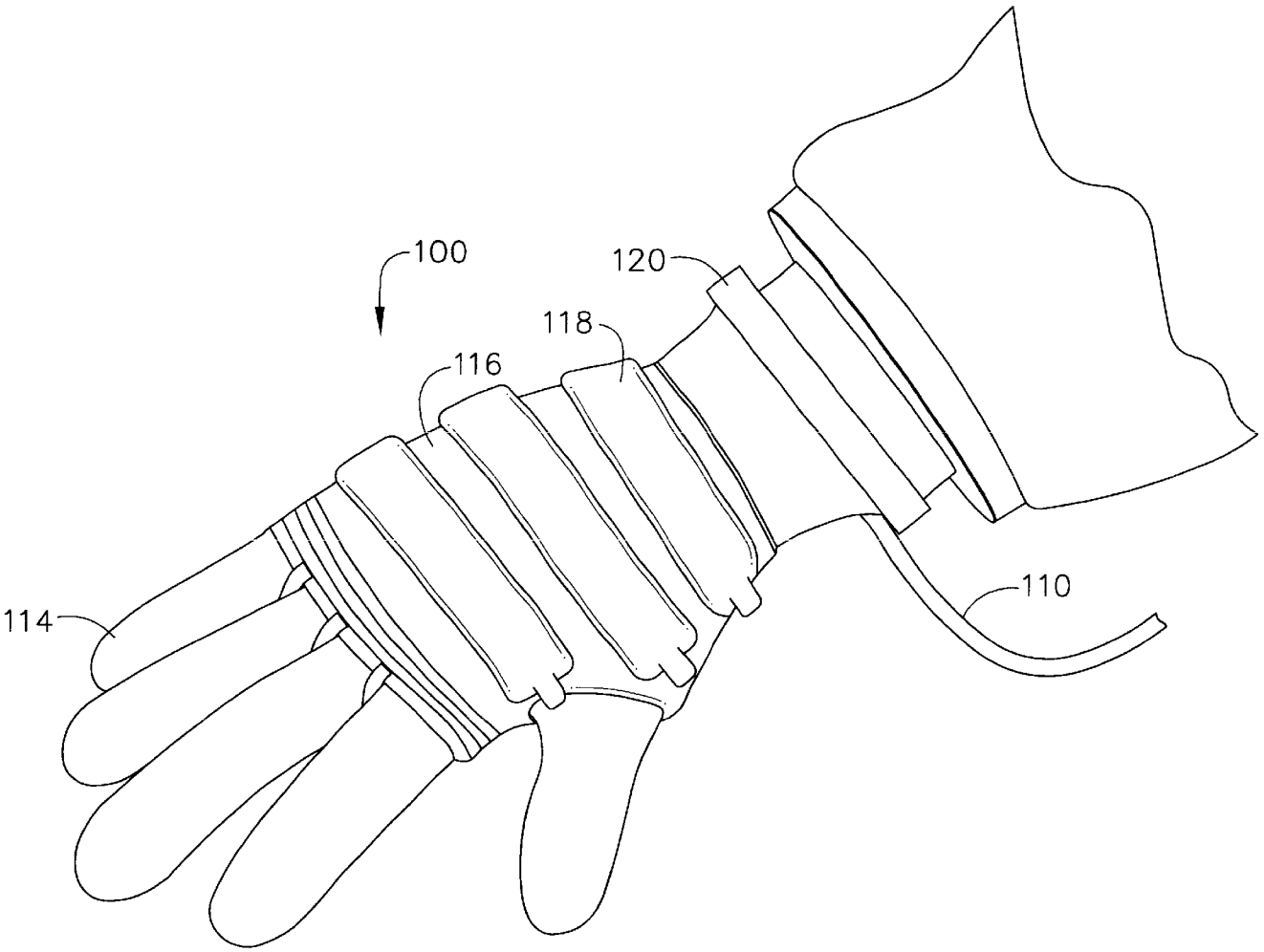
FIG. 1A is an elevated perspective view of the counter pressure glove system of the present invention.
Figure 1B:
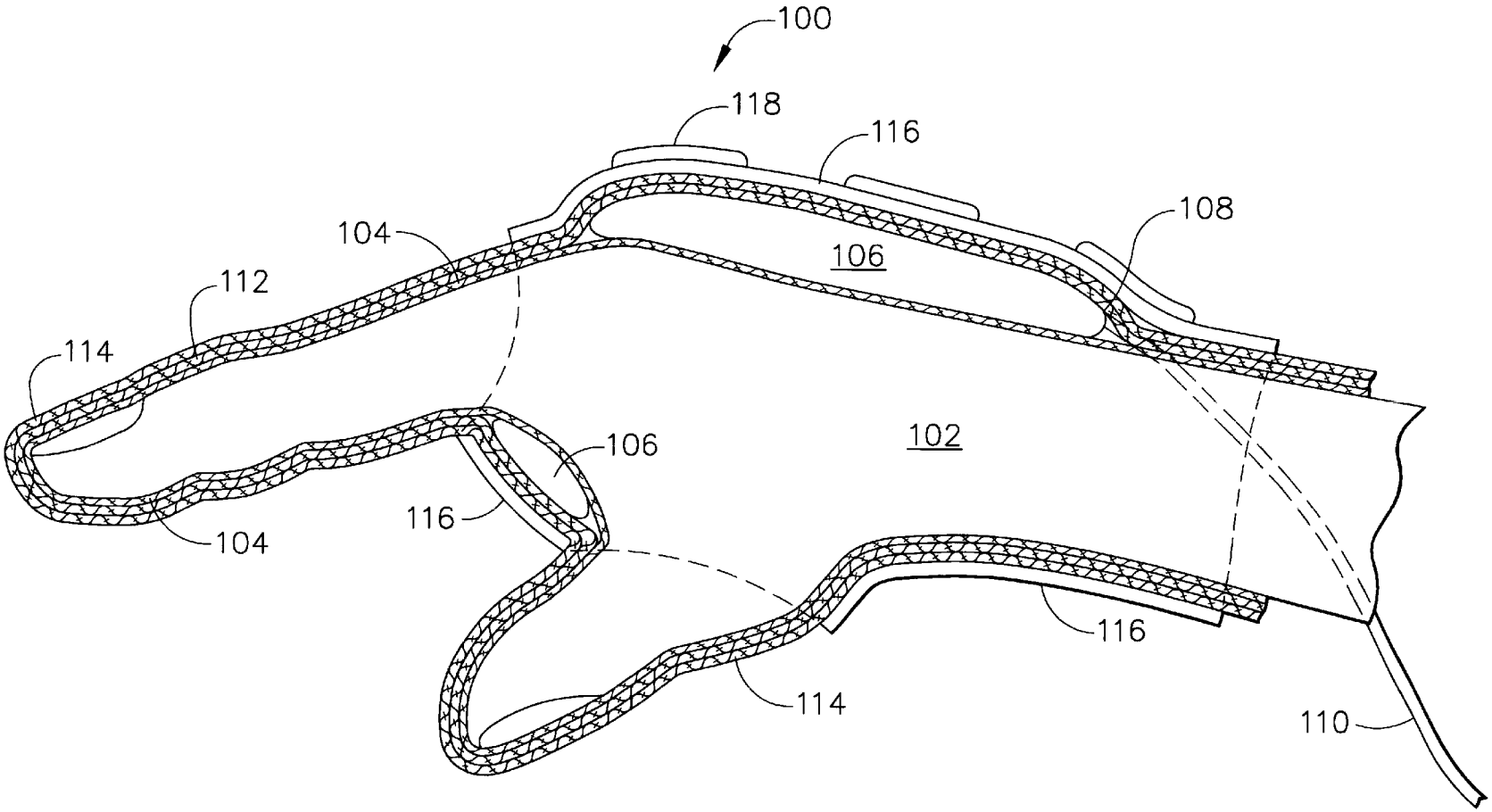
FIG. 1B is a cross sectional view of the counter pressure glove system shown in FIG. 1A.

Reference will now be made to drawings wherein like numerals refer to like parts throughout. FIGS. 1A and 1B illustrate a mechanical counter pressure glove system 100 of the present invention, which is shown as donned on a right hand 102 of a user (not shown). In this embodiment, the glove system 100 may initially comprise a comfort layer or base glove 104 that can be donned on the hand 102. A pressure member or bladder 106 of the glove system 100 may be donned upon the base glove 104 and partially covering the base glove 104. The pressure member may comprise an inlet port 108 and an inlet tube 110 connected to the inlet port 108. The inlet tube 110 is connected to a pressure source (not shown) to inflate the pressure member 106.

A slip layer or low friction base glove 112 of the glove system 100 may be donned on the pressure member 106 and the exposed areas of the comfort layer or base glove 104. A power layer or pressure glove 114 of the glove system 100 may then be donned on the low friction glove 112. The material of the low friction base glove 112 permits easy donning and doffing of the power layer or pressure glove 114. A support member or gauntlet 116 of the glove system 100 may next be donned on the pressure glove 114 to prevent any displacement of the pressure member 106, i.e., any lateral and vertical displacement away from the original position of the pressure member 106. The gauntlet or support member 116 may partially cover the power layer or pressure glove 114 and comprises a number of fastening flaps 118 on top of the support member 116. Referring to FIG. 1A, the mechanical counter pressure glove system 100 may be attached to a cuff section 120 of a space suit (not shown).

Figure 2A:
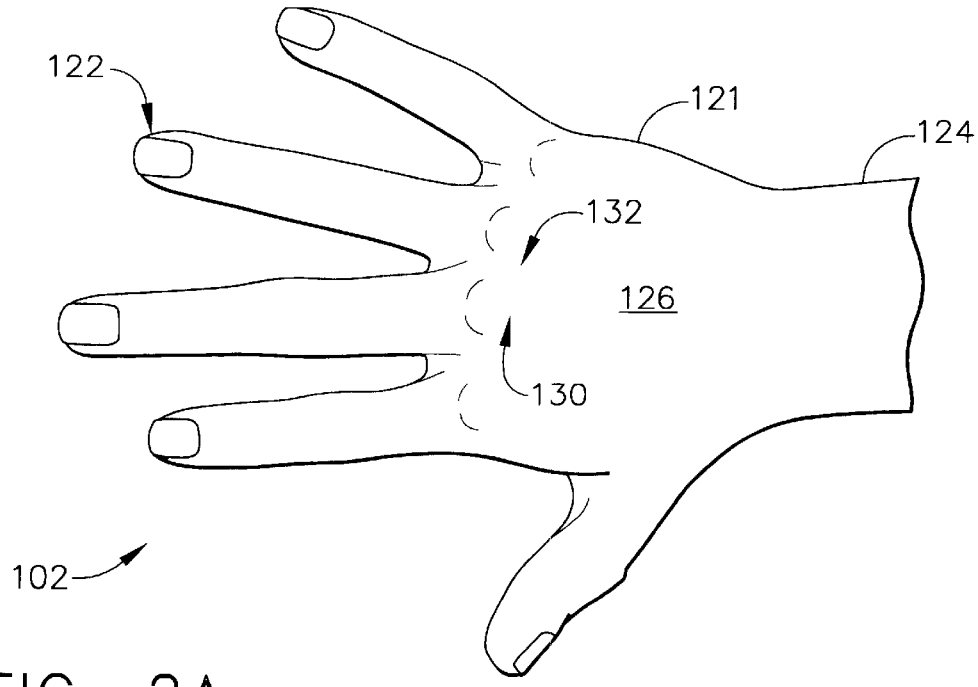
FIGS. 2A–2B are schematic views of a right hand showing the relative locations of the dorsal metacarpal and the palmar knuckles of the hand.
Figure 2B:
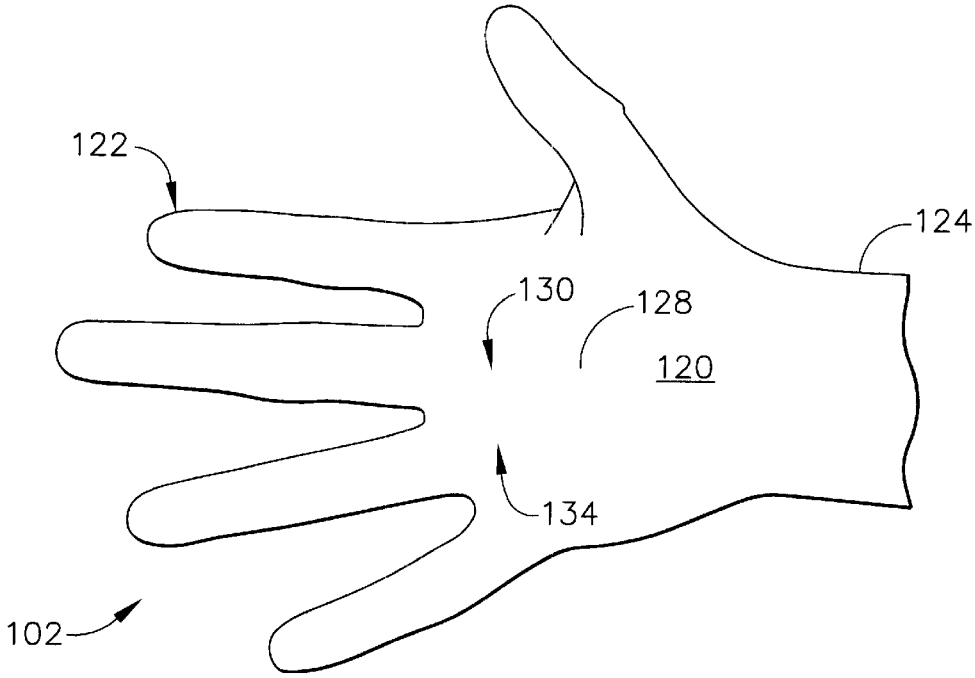

To explain the terminology regarding a human hand and its relationship to the subject invention, FIGS. 2A and 2B illustrate various sections of a right hand 102 having a palm 121 extending between the fingers 122 and the wrist 124. The dorsal metacarpals 126 and palmar metacarpals 128 cover the top (FIG. 2A) and the bottom of the palm 121 (FIG. 2B), respectively. The palm 121 is connected to the fingers 122 through knuckles 130. The dorsal metacarpal side of the knuckles 130 is called dorsal knuckles 132 and the palmar metacarpal side of the knuckles 130 is called palmar knuckles 134.

During an extra vehicular activity in outer space, or other environment having no or very low atmospheric pressure, the pressure exerted by the glove system 100 functions as a mechanical counter pressure which prevents soft tissue swelling caused by the pressure difference. The mechanical counter pressure is needed to counter balance the pressure difference between the arterial and venous blood vessels and the external pressure during an extra vehicular activity.

Providing mechanical counter pressure to the dorsal metacarpals 126 and the palmar knuckles 134 is very difficult using the prior art systems, such as foams or hard inserts. Despite the fact that the mobility of the hand is critical for extra vehicular activities, the prior art do not allow adequate motion of the hand and fingers. The dorsal metacarpals 126 and the palmar knuckles 134 are highly variable in surface shape, and far from being circular. When placed into a vacuum environment, the glove system 100 advantageously provides the necessary mechanical counter pressure across the hand 102 including the dorsal metacarpals 126 and the palmar knuckles 134, while allowing full range of the motion of the hand.

Figure 3A:
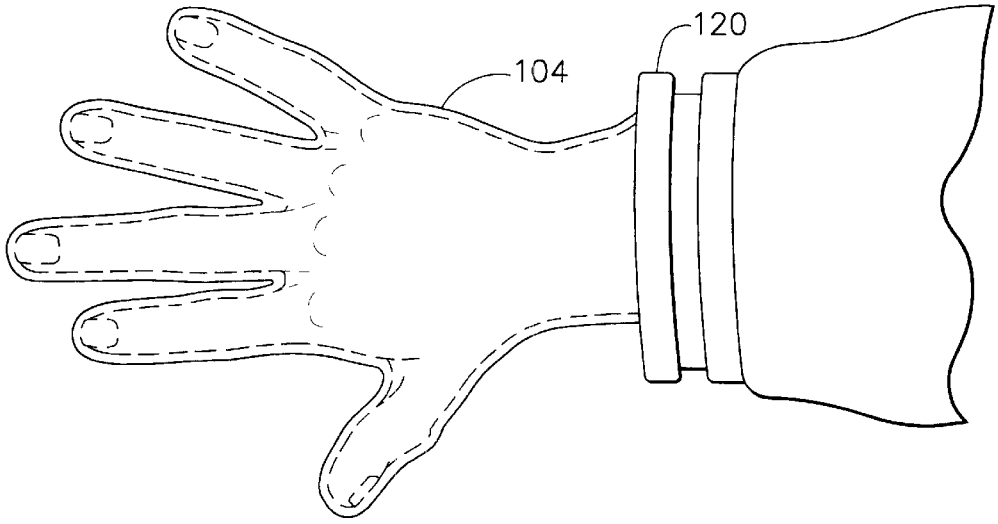
FIGS. 3A–3B are schematic top and bottom views of a base glove of the present invention.
Figure 3B:
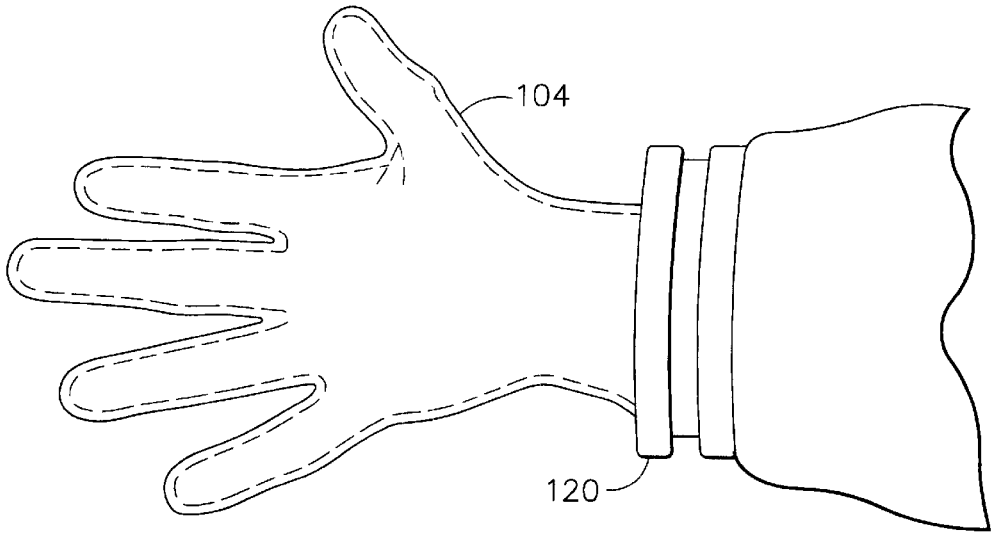

In more specifically describing the present invention, FIGS. 3A and 3B show the comfort layer or base glove 104 of the glove system 100. In this embodiment, the base glove 104 is shown donned on the hand 102, which substantially conforms the shape of the hand 102 and makes direct contact with the soft tissue of the hand. The base glove 104 may be made of a stretchable material. Preferably, the base glove 104 is knitted out of a yarn which is mostly flat (non-twisted) nylon or polyester. The base glove 104 may also comprise small amount of elastomeric yarn. The comfort layer or base glove 104 provides comfort between the hand of the wearer and the other components of the system 100. Further, the base glove 104 minimizes friction that may occur between the hand 102 and the subsequent components as the glove system 100 is donned. As will be described below, in this embodiment, the subsequent components are the pressure member 106 and the low friction glove 112. Thus, the base glove allows the pressure member 106 and the low friction glove 112 to be donned easily.

Figure 4A:
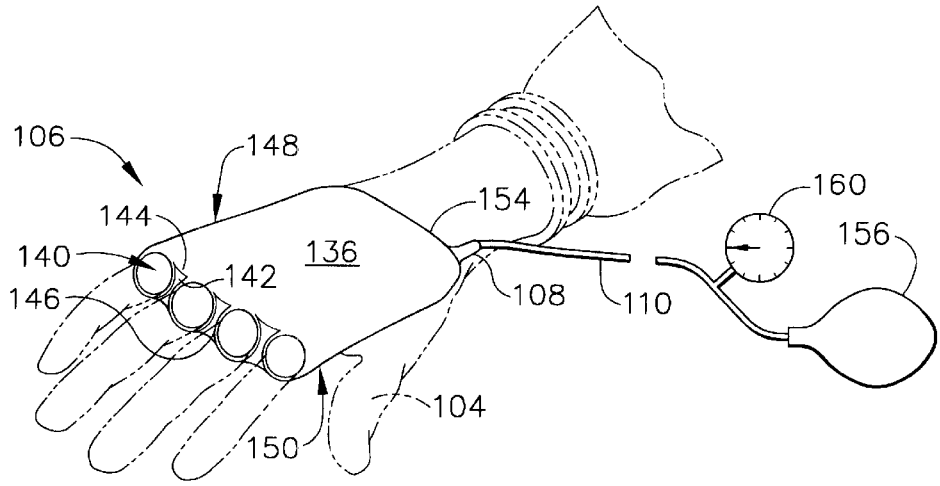
FIG. 4A is an elevated perspective view of a pressure member of the present invention, wherein an upper bladder of the pressure member has been disposed on the dorsal metacarpals of the hand having the base glove shown in FIGS. 3A–3B.
Figure 4B:
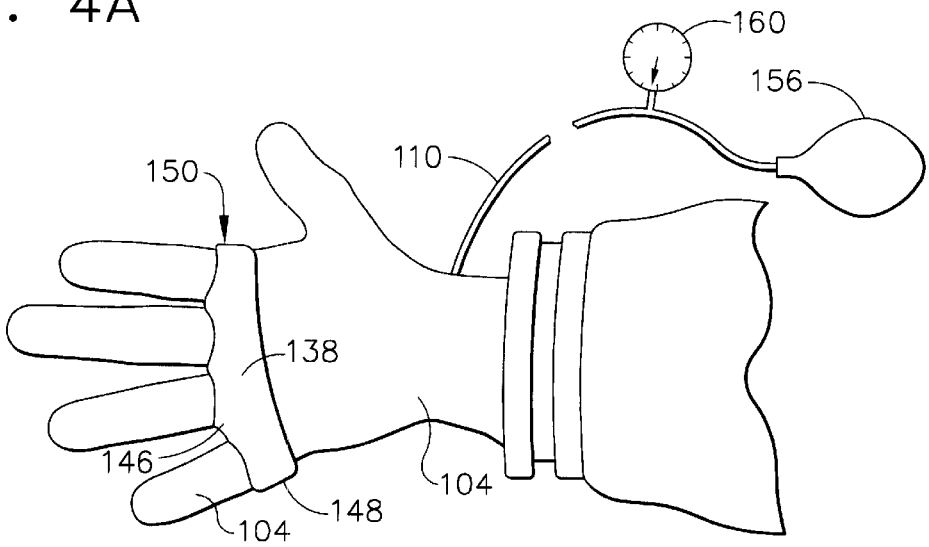
FIG. 4B is a bottom view of the pressure member shown in FIG. 4A, wherein a lower bladder of the pressure member has been disposed on the palmar knuckles of the hand.
Figure 4C:
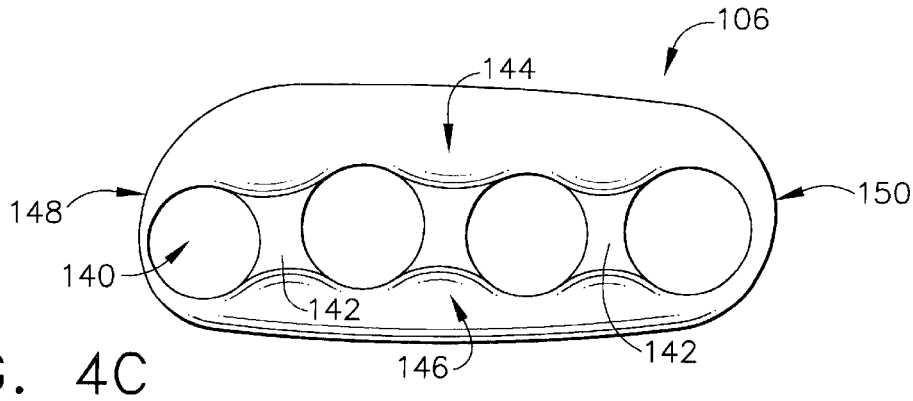
FIG. 4C is a schematic front view of the pressure member shown in FIGS. 4A–4B.

As shown in FIGS. 4A–4C, after donning the comfort layer or base glove 104, the bladder or pressure inducing member 106 may be donned on the base glove 104. In this embodiment, when donned on the comfort layer 104, the bladder 106 substantially covers the palmar knuckles 134 and the dorsal metacarpals 126 including dorsal knuckles 132 of the hand 102 (FIGS. 2A and 2B). As will be described more fully below, the power layer 114 of the glove system 100 provides the majority of the mechanical counter pressure on the hand. However, due to the irregular shape of the dorsal metacarpals 126 and the palmar knuckles 134, the power layer 114 may not adequately supply a counter pressure over these particular areas of the hand (FIGS. 2A–2B). This limitation of the power layer 114 may be compensated with the use of the pressure member 106 on such areas.

The pressure inducing member 106 may, in one preferred embodiment, be adapted to comprise two integrally connected inflatable components, namely, an upper bladder 136 and a lower bladder 138. The upper bladder 136 covers the dorsal metacarpals 126 including the dorsal knuckles 132 while the lower bladder 138 covers the palmar knuckles 134. When inflated with a pressure agent such as gas, liquid or a gel material, the upper and lower bladders 136 and 138 supply adequate mechanical counter pressure over the soft tissue covering the dorsal metacarpals 126 including the dorsal knuckles 132 and the palmar knuckles 134 while still providing full hand mobility. The pressure inducing member 106 may be a form-fitted member that is sized and dimensioned to fit a hand and conforms to the individual shape of the hand. In use, the pressure member 106 may be donned as inflated to a predetermined pressure level. Alternatively, the pressure member 106 may be inflated to the adequate counter pressure, for example, after either donning the pressure member 106 or donning the glove system 100. During an extra vehicular activity in outer space, for example, the pressure exerted by the bladders 136 and 138 functions as a mechanical counter pressure which prevents soft tissue swelling caused by the pressure difference. As described above, the mechanical counter pressure is needed to counter balance the pressure difference between the arterial and venous blood vessels and the external pressure.

Referring to FIGS. 4A–4C, finger holes 140 allow the pressure member 106 to be placed over the hand 102 by inserting four fingers (the little, ring, middle and index fingers) through the holes 140. Tabs 142 extending between a distal end 144 of the upper bladder 136 and a distal end 146 of the lower bladder 138 function to define the finger openings 140 as well as to connect the upper and lower bladder 136 and 138 to each other. Tabs 142 also provide additional counter pressure in the webs between the fingers. Additionally, a first and second side sections 148 and 150 form the sides of the pressure member 106, hence, further securing and aligning the pressure member 106 on the hand 102. The inlet port 108 may be located at a proximal end 154 of the upper bladder 136. The inlet port 108 may be connected to a pressure source 156 and a pressure gauge 160 through the inlet tube 110. The pressure gauge 160 optimizes the operating pressure of the pressure member 106, thereby allowing a user to adjust the pressure level of the pressure member 106. In one embodiment, the pressure source 156 may be a rubber squeeze bulb to pump air into the upper and lower bladders 136 and 138. The inlet port 108 may be, for example, formed as a pinch valve or the like. Via a pinch valve, the pressure member 106 may be inflated to an appropriate pressure range by the bulb 156; after removing the bulb 156, the pressure member 106 may be sealed by permanently sealing the pinch valve.

As previously mentioned, providing mechanical counter pressure to the dorsal metacarpals and the palmar knuckles is difficult using the prior art, as they are highly variable in surface shape. Mobility of the hand is critical, such as for extra vehicular activities in outer space. The prior art hand inserts or foams do not allow adequate motion of the hand and fingers. When placed into a vacuum environment, the pressure member 106 advantageously provides the necessary mechanical counter pressure across the dorsal metacarpals 126 and the palmar knuckles 134, while allowing full range of the motion of the hand.

Figure 4D:
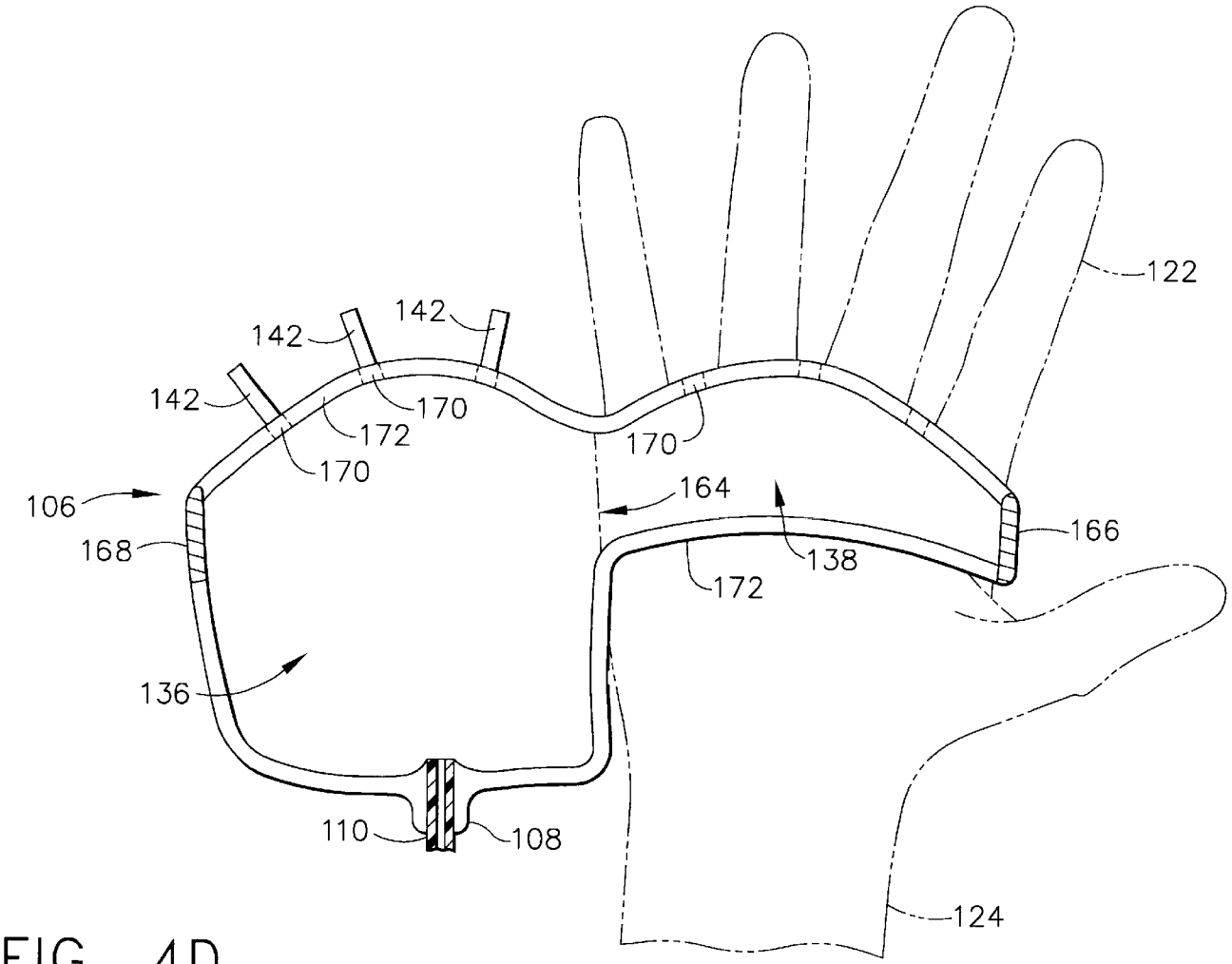
FIG. 4D is another schematic view of the pressure member shown in FIGS. 4A–4C.

As shown in FIG. 4D, in another preferred embodiment, the pressure member 106 may be a single bladder or a bag that may be inflated using the inlet port 108. As a single bladder, the pressure member 106 may comprise the upper and lower bladders 136 and 138 of the above embodiment. The upper bladder 136 may be in fluid communication with the lower bladder 138 so that air from the inlet port 108 inflates both of them. In order to secure pressure member 106 around the hand, the lower bladder 138 may be folded along a fold line 164 over the upper bladder 136 and the respective ends 166 and 168 are attached to each other. Accordingly, once the pressure member 106 is formed, the folded edge may correspond to the first section or edge 148 of the pressure member 106 (FIGS. 4A–4C). Similarly, the attached edge may correspond to the second section or edge 150 of the pressure member 106. In this embodiment, the omission of edges 148, 150 better allows the pressure agent within the bladder 106 to move from one part to the other as the hand moves.

In the next manufacturing step, the tabs 142 are attached to the respective attachment locations 170 on the distal ends 144 and 146 of the bladders 136 and 138. The pressure member 106 may preferably be made by cutting two material layers into the shape of the pressure member 106 as shown in FIG. 4D. Then, the layers with matching shapes are put on top of each other and sealed along the peripheral edge 172. In a preferred embodiment, a material for the pressure member 106 may be polyurethane such as that available from JASCO Products, Inc. The edge 172 may be sealed using Radio Frequency (RF) welding or other conventional methods using adhesives or heat sealing. RF welding may be used to attach the ends 166 and 168 as well as tabs 142 to the attachment locations 170. The pressure member 106 of the present invention may withstand a gas pressure in the range of about 4 to 8 psid, preferably about 4 to 5 psid.

It is further within the scope of the present invention to replace one of the bladders 136 and 138 with an alternative form of counter pressure means such as foam inserts or the like. The tab members 142 or webbing are to align the pressure member 106 on the hand. An alternative embodiment may remove the tab members 142 permanently or replace them with other alignment means. Also, in an alternative embodiment, the inlet tube 110 may be not necessary if the pressure member is inflated to the required pressure level and is subsequently temporarily or permanently sealed at that pressure level.

Figure 5A:
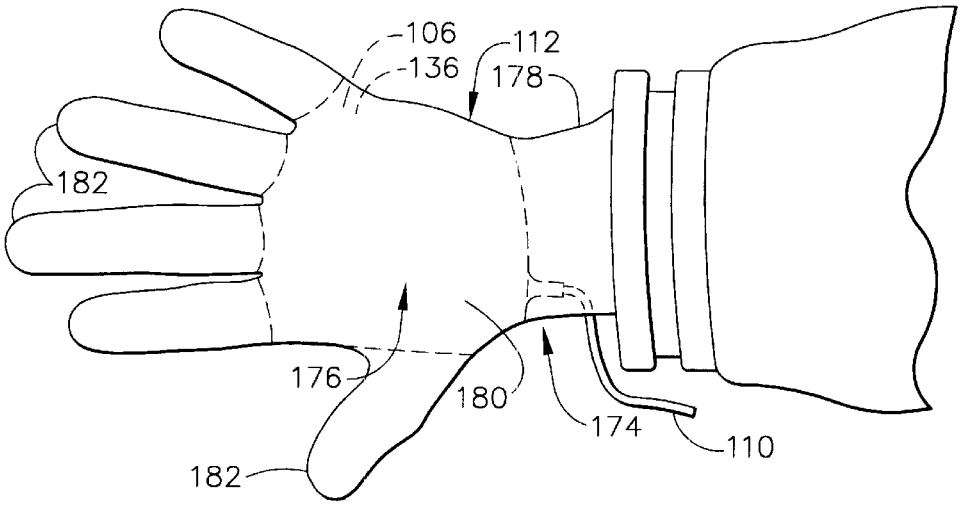
FIGS. 5A–5B are schematic top and bottom views of a low friction glove of the present invention, wherein the low friction glove has been donned on the pressure member shown in FIGS. 4A–4C.
Figure 5B:
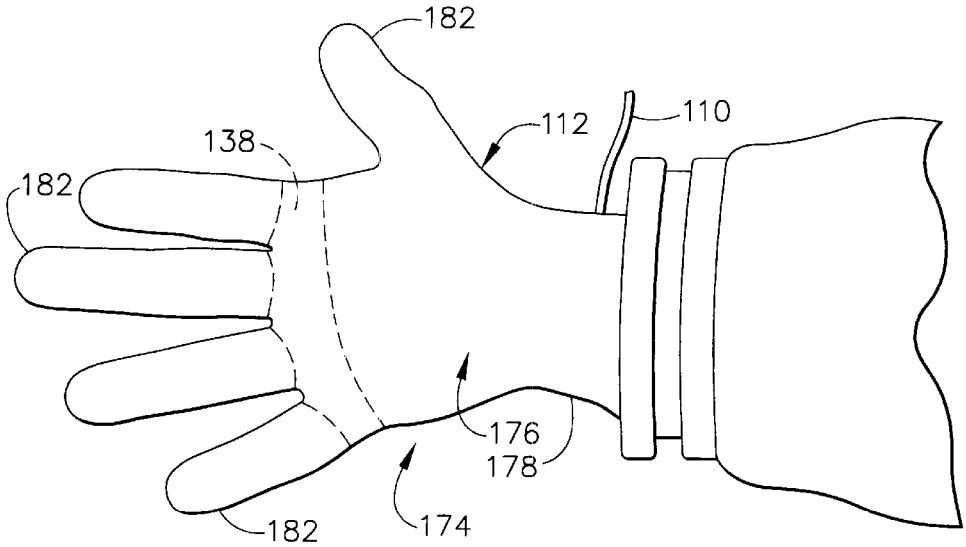
Figure 5C:
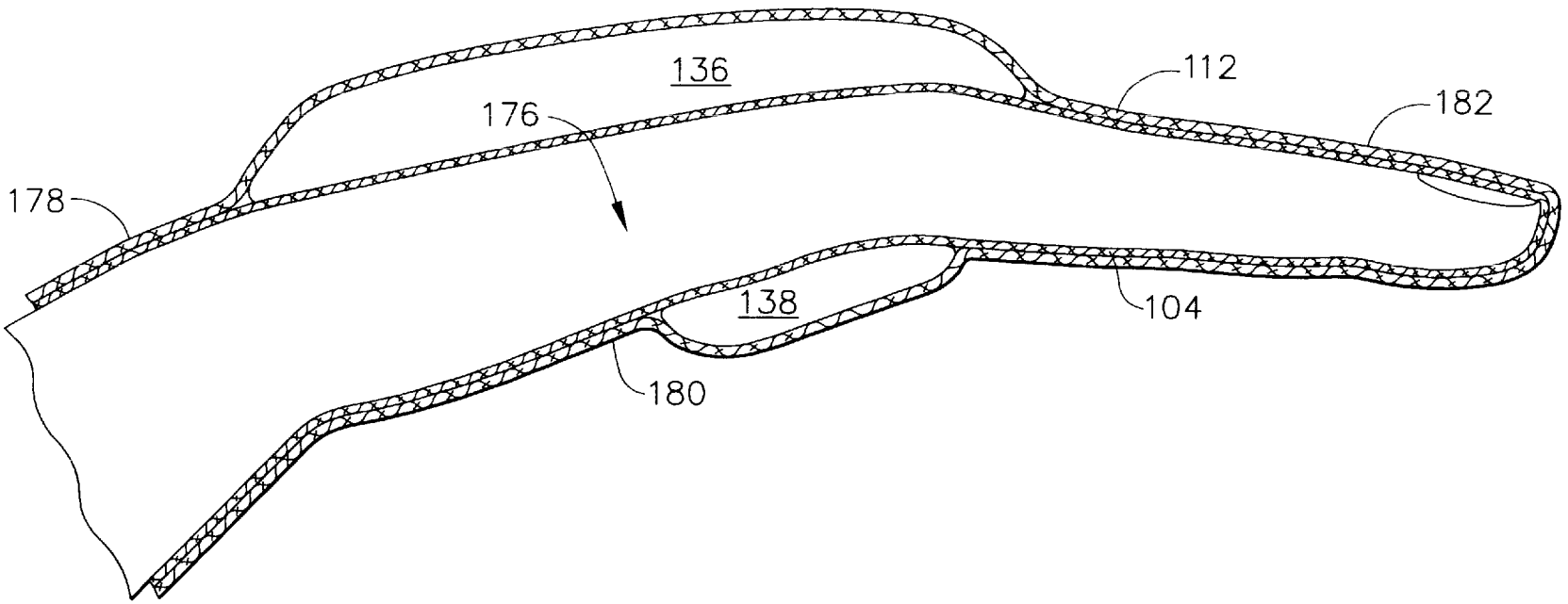
FIG. 5C is a cross sectional view of the glove system of the present invention which is after the low friction glove shown in FIGS. 5A–5B has been donned.

As illustrated in FIGS. 5A to 5C, after donning of the pressure member 106 on the comfort layer or base glove 104, the slip layer or low friction glove 112 of the glove system 100 may be donned. The slip layer 112 covers the pressure member 106 and the exposed portions of the comfort layer 104. The low friction glove 112 may comprise a body portion 174 defining an inner volume 176 to receive a hand of a wearer. The body portion 174 further defines a wrist portion 178 and a palm portion 180 to receive the wrist and palm, while finger portions 182 receive the fingers and thumb. The position of the pressure member 106 after the donning of the glove 112 is illustrated by the broken lines in FIGS. 5A–5C. The low friction glove 112 forms a slip layer of the glove system 100 so as to facilitate donning and doffing of the power layer or pressure glove 114. If no slip layer 112 is utilized, the strong elastic material of the pressure glove 114 makes the donning process of the pressure glove 114 very difficult.

As will be described more fully below, the pressure glove 114 forms a power layer that provides the majority of the mechanical counter pressure on a hand. To be able to exert necessary mechanical counter pressure on the hand, the pressure glove 114 is made of a very strong elastic material. However, due to this property of the glove, it is very difficult to pull the pressure glove 114 over the pressure member 106 or the exposed portions of the base glove 104. Without having the low friction glove 112, if the pressure glove 114 is fully pulled to be donned, the pressure glove 114 may be fatigued from the strenuous pulling and friction, which impairs its mechanical counter pressure function.

In a preferred embodiment, the low friction glove 112 may be made of a low friction material, preferably PTFE (polytetrafluoroethlene), also referred to as Teflon™. In one embodiment, the low friction glove may be made of PTFE yarn that is seamlessly knitted into a glove. The PTFE yarn may be available from Dupont. The knitting process may be carried out using a knitting machine such as that available from Shima Seiki. The low friction glove 112 significantly lessens the fatigue that may be built up in the pressure glove 114 during the donning process. It is within the scope of the present invention that the low friction glove 112 may be manufactured using other manufacturing methods such as sewing disparate pieces made of PTFE material.

Figure 6A:
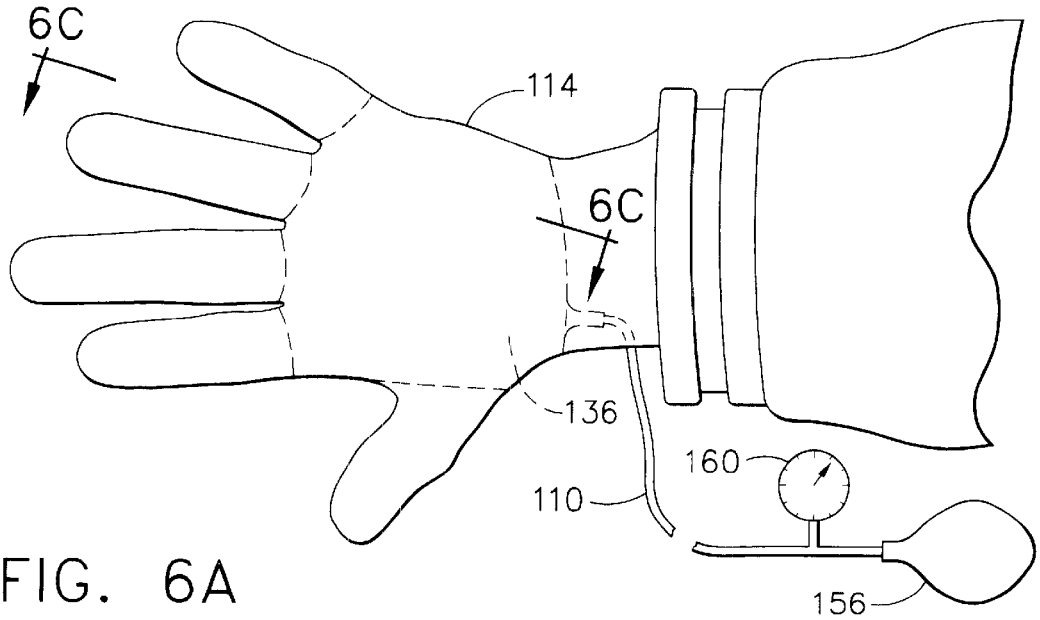
FIGS. 6A–6B are schematic top and bottom views of a pressure glove of the present invention, wherein the pressure glove has been donned on the low friction glove shown in FIGS. 5A–5C.
Figure 6B:
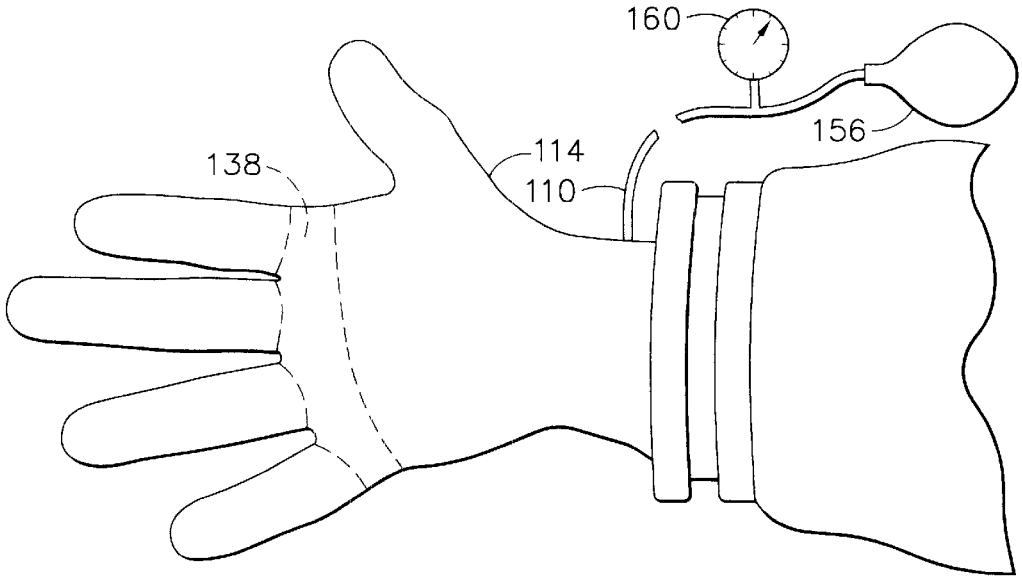
Figure 6C:
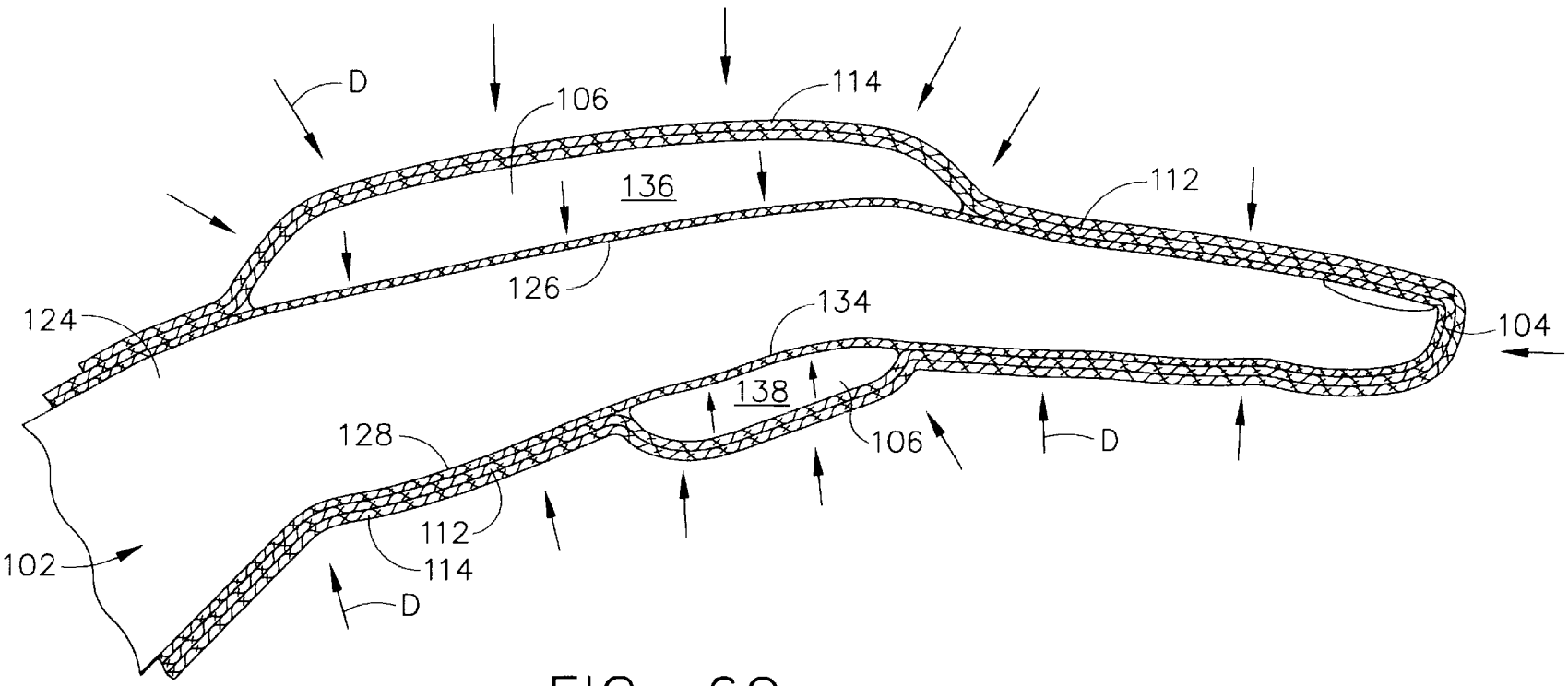
FIG. 6C is a cross sectional view of the glove system of the present invention which is after the low friction glove shown in FIGS. 6A–6B has been donned.
Figure 7A:
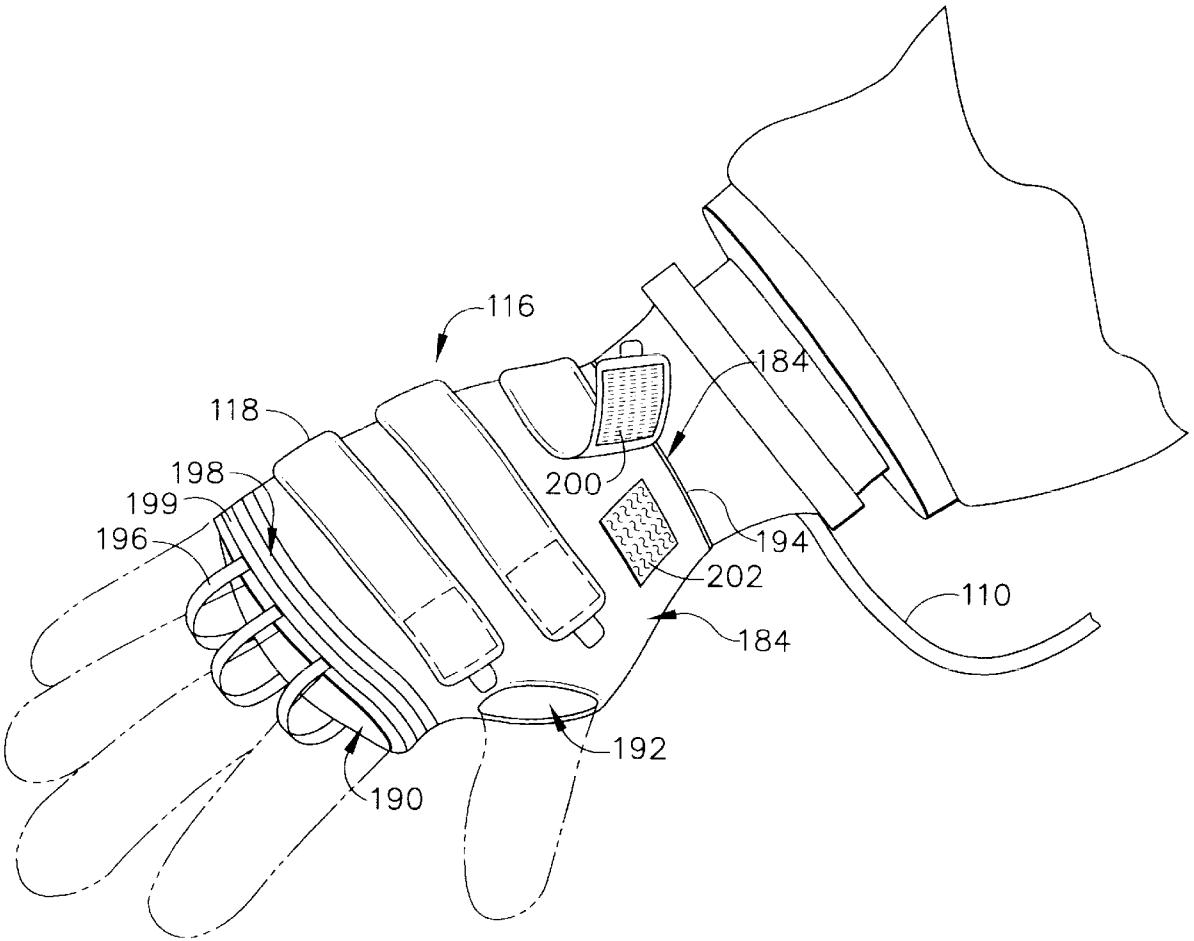
FIG. 7A is an elevated perspective view of the gauntlet of the present invention.
Figure 7B:
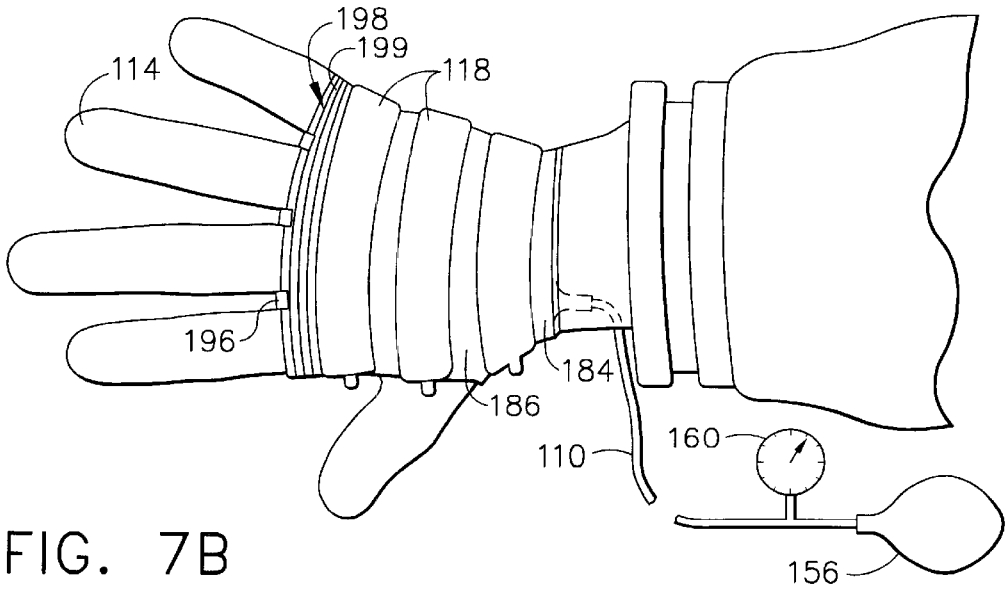
FIGS. 7B–7C are top and bottom views of the gauntlet of the present invention, wherein the gauntlet has been donned on the pressure glove shown in FIGS. 6A–6C.
Figure 7C:
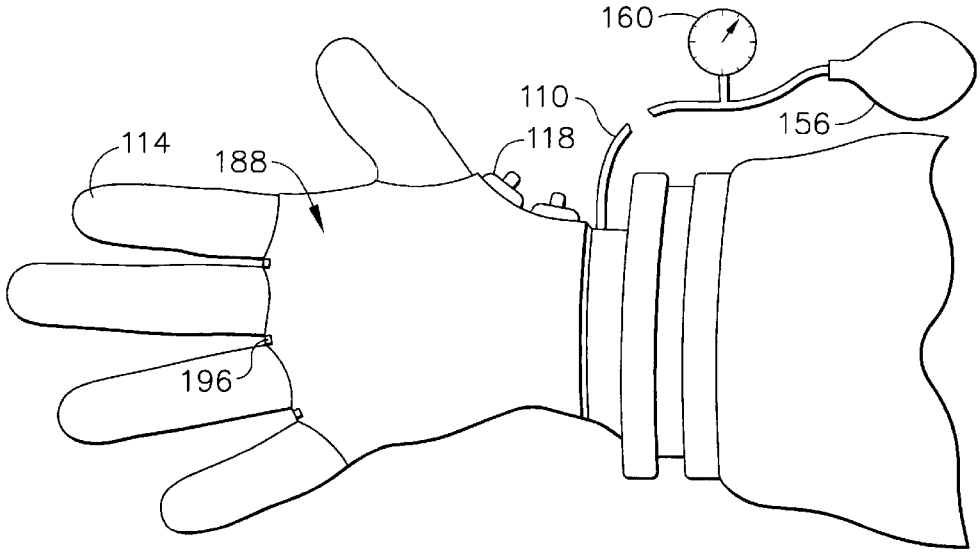
Figure 7D:
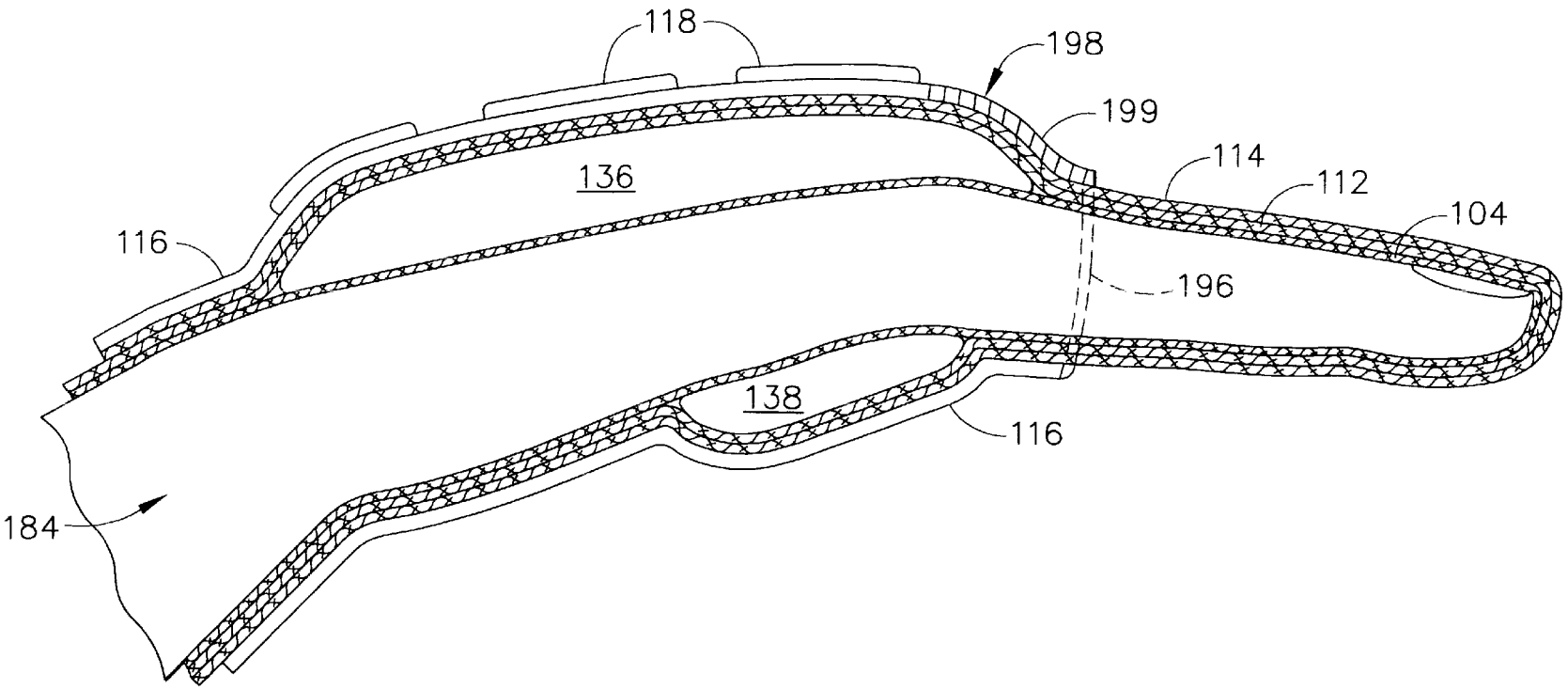
FIG. 7D is a cross sectional view of the glove system of the present invention which is after the gauntlet shown in FIGS. 7A–7C has been donned.

As shown in FIGS. 6A and 6B, the power layer or pressure inducing glove 114 may be donned on the low friction glove 112. The pressure glove 114 forms a pressure or power layer of the glove system 100. As discussed above, the elastic material of the pressure glove 114 may not apply an adequate counter pressure on the dorsal metacarpals 126 and the palmar knuckles 134 due to the relatively irregular shape of these areas of the hand 102 (FIGS. 2A–2B). However, the combined use of the pressure member 106 and the pressure glove 114 within the glove system 100 of the present invention substantially minimize this problem. FIG. 6C shows how the pressure member 106 and the pressure glove 114 function together when the pressure member 106 is inflated.

Referring now to FIGS. 6A to 6C, over the dorsal metacarpals 126 and the palmar knuckles 134, the pressure glove 114 and the pressure member 106 together establish a mechanical counter pressure in the direction D substantially normal to the tissue of the hand. However, the mechanical counter pressure for the rest of the hand (such as the fingers, wrist and the rest of the palmar metacarpals 128) may be provided only by the pressure glove 114. The pressure glove 114 may be made of Globespun™ yarn, preferably 850 denier nylon covered Globespun™ yarn, that is seamlessly knitted into a glove. The 850 denier nylon covered Globespun™ yarn may be available from Dupont. The knitting process may be carried out using a knitting machine such as that available from Shima Seiki.

As shown in FIGS. 7A–7D, after donning the pressure glove 114, the gauntlet or support member 116 of the glove system 100 may be donned on the pressure glove 114. The support member 114 prevents pressure member 106 from moving laterally over the fingers or ballooning vertically when the system 100 is used during an extravehicular activity, for example. Further, the support member 116 restrains the pressure member 106 and keeps the pressure member thin and flexible when the hand is used. In the preferred embodiment, the support member 116 may be formed as a gauntlet having a gauntlet body 184 covering the wrist and the palm of a wearer. The body 184 may have a top and bottom portions 186 and 188 connected together in a face to face relationship to define the gauntlet body 184.

The top and bottom portions 186 and 188 may be configured and sewn together to define a front opening 190 to receive four fingers, a thumb opening 192 to receive the thumb, and a wrist opening 194 to insert the hand. The top and bottom portions 186 and 188 may preferably be made of a cloth comprising Nomex™ that may be available from ILC Dover. At the front opening 190, webbing strips 196 extend between the top and bottom portions 186 and 188. There are three webbing strips 196 spaced and dimensioned such that when the gauntlet is donned the webbing strips 196 are aligned between the four fingers as in the manner shown in FIGS. 7A–7C. As such, the webbing strips 196 apply some mechanical counter pressure between the fingers and further stabilize the gauntlet 116. The webbing strips 196 may preferably be made of a flexible, high initial modulus reinforcement strips that have low flammability. A front section 198 of the top portion 186 may have pleats 199 that allow fingers to bend forward into a fist or for grasping objects. The pleats 199 may be formed from folded over Nomex™ material. Further, the top portion 186 has the fastening flaps 118. Preferably, three fastening flaps extend across the top portion 186 of the gauntlet 116. A hook portion 200 of a coacting hook and loop fastener is preferably mounted on one face of the fastening flaps 118. The hook portion 200 may be selectively connected to the loop portion 202 that is mounted on selected locations on the top portion 186. In this manner, using the fastening flaps 118, the gauntlet 116 can be adjusted to the size of a user's hand. Such hook and loop fasteners are commercially available and sold under the brand name Velcro™.

Although, in the preferred embodiment, the gauntlet 116 is made of Nomex™, it is within the scope of this invention that any cloth with enough strength to withstand the force of the pressure member 106 may be used. Similarly, the Velcro™ fasteners may be replaced with other fasteners such as hooks, snaps, buttons or just ties. The pleats over the dorsal knuckles may be replaced with alternative systems. Such alternative systems may include the use of two pieces of cloth which pass over each other at the dorsal knuckle, or deep pockets that allow knuckle motion.

After the donning of the glove system 100 is completed, in one embodiment, the pressure member 106 may be inflated to the predetermined pressure level. This predetermined pressure level may be in the range of about 4 to 5.8 psid, depending on the supplied breathing pressure. In the next step the tube 110 may be separated from the pressure source and sealed.

It should be understood, of course, that the foregoing relates to preferred embodiments of the invention and that modifications may be made without departing from the spirit and scope of the invention as set forth in the following claims.

We claim:

1. A mechanical counter pressure glove system for use in low pressure environments including outer space, comprising;

a first base glove defining an internal volume for receiving a hand of a wearer and comprising a low friction material;

a pressure inducing member; and a pressure inducing glove, the pressure inducing glove configured to apply mechanical counter pressure on the hand sufficient for use in outer space and wherein the low friction material of the first base glove facilitates donning of the pressure inducing glove.

2. The mechanical counter pressure glove system of claim 1, wherein the first base glove is knitted from a yarn that is composed of low friction material.

3. The mechanical counter pressure glove system of claim 2, wherein the low friction material is PTFE.

4. The mechanical counter pressure glove system of claim 2, wherein the first base glove is seamless.

5. The mechanical counter pressure glove system of claim 1, wherein the pressure inducing glove is composed of an elastomeric material.

6. The mechanical counter pressure glove system of claim 5, wherein the elastomeric material is a nylon covered yarn material.

7. The mechanical counter pressure glove system of claim 1, wherein the pressure inducing member is disposed between the hand of a wearer and the first base glove.

8. The mechanical counter pressure glove system of claim 7, wherein the pressure inducing member comprises an inflatable bladder.

9. The mechanical counter pressure glove system of claim 8, further comprising a second base glove over which the inflatable bladder is disposed.

10. The mechanical counter pressure glove system of claim 8, further comprising a support glove which is disposed over the pressure inducing glove, wherein the support glove restrains the inflatable bladder.

11. The mechanical counter pressure glove system of claim 1, wherein the first base glove is a slip layer in the mechanical counter pressure glove system.

12. A donning-enabling garment for use in a mechanical counter pressure glove system usable in low pressure environments including outer space, the glove system comprising a pressure inducing member and a power inducing glove, and the donning-enabling garment comprising:

a seamless body of a low friction material defining an internal volume for receiving a hand of a wearer, wherein the seamless body is knitted from a yarn that consists essentially of PTFE and wherein the seamless body defines a finger portion for receiving the fingers and the thumb, a palm portion for receiving the palm, and a wrist portion for receiving the wrist of the hand, wherein the seamless body is configured to receive a pressure inducing member between the hand of the wearer and the seamless body and the low friction material facilitates donning of a pressure inducing glove thereover.

13. The donning-enabling garment of claim 12, further comprising a pressure inducing member and a pressure inducing glove.

14. The donning-enabling garment of claim 12, wherein the seamless body is donned prior to a pressure inducing glove.

15. A mechanical counter pressure glove system for use in low pressure environments including outer space, comprising;

a seamless first base glove defining an internal volume for receiving a hand of a wearer and comprising a low friction, knitted, PTFE material;

a pressure inducing member comprising an inflatable bladder being disposed between the hand and the first base glove;

a pressure inducing glove, the pressure inducing glove configured to apply mechanical pressure on the hand sufficient for use in outer space and being composed of an elastomeric material;

a second base glove over which the inflatable bladder is disposed; and a support glove which is disposed over the pressure inducing glove, wherein the support glove restrains the inflatable bladder;

wherein the low friction, knitted, material of the first base glove facilitates donning of the pressure inducing glove.

* * * * *